US007198160B2

(12) United States Patent
Ernst et al.

(10) Patent No.: US 7,198,160 B2
(45) Date of Patent: Apr. 3, 2007

(54) SALES RACK

(75) Inventors: Peter Ernst, Mülheim/Ruhr (DE); Robert Ochsenschläger, Mülheim/Ruhr (DE)

(73) Assignee: Aldi Einkauf GmbH & Co. oHG, Mülheim/Ruhr (DE)

( * ) Notice: Subject to any disclaimer, the term of this patent is extended or adjusted under 35 U.S.C. 154(b) by 154 days.

(21) Appl. No.: 10/881,912

(22) Filed: Jun. 30, 2004

(65) Prior Publication Data

US 2005/0011845 A1 Jan. 20, 2005

(30) Foreign Application Priority Data

Jul. 3, 2003 (DE) ..... 203 10 267

(51) Int. Cl.
*A47F 5/08* (2006.01)

(52) U.S. Cl. ..... 211/150; 211/150; 211/85.31; 211/126.8; 211/168

(58) Field of Classification Search ..... 211/150, 211/149, 175, 47, 80, 85.31, 119.003, 126.1, 211/126.6, 126.8, 126.9, 133.5, 168, 174, 211/104, 90.02, 169, 195; 248/44.1, 441.1; 261/DIG. 14

See application file for complete search history.

(56) References Cited

U.S. PATENT DOCUMENTS 1,283,326 A * 10/1918 Schreck ..... 211/182
1,711,585 A * 5/1929 Brunhoff ..... 248/465
2,633,249 A * 3/1953 Reed ..... 211/130.1
2,793,760 A * 5/1957 Zel et al. ..... 211/55
3,586,411 A * 6/1971 Brigham ..... 312/351
5,503,279 A * 4/1996 Wentworth ..... 211/175
D390,728 S * 2/1998 Herman et al. ..... D6/474
RE36,638 E * 4/2000 Herman ..... 278/14
6,073,783 A * 6/2000 Allman ..... 211/85.3
6,158,600 A * 12/2000 Ferrucci et al. ..... 211/90.02
6,357,605 B1 * 3/2002 Martorella ..... 211/41.6
6,390,310 B1 5/2002 Insalaco
2001/0035385 A1 11/2001 Sosso

FOREIGN PATENT DOCUMENTS

DE 92 13 214.6 2/1993
DE 694 00 802 5/1997
DE 199 18 604 10/2000

* cited by examiner

*Primary Examiner*—Richard E. Chilcot, Jr.
*Assistant Examiner*—Lindsay M. Maguire
(74) *Attorney, Agent, or Firm*—Collard & Roe, P.C.

(57) ABSTRACT

A sales rack for accommodating goods such as foods presented in open containers, such as fruits, vegetables, etc. The sales rack has a base and a goods support surface that is adjustable relative to the base. The goods support surface is equipped with at least one holder element which can be optionally affixed, and over which the goods, i.e. the containers can pass when they are put into place, to fix the goods in place in the slanted position of the goods support surface.

8 Claims, 5 Drawing Sheets

SALES RACK

BACKGROUND OF THE INVENTION

1. Field of the Invention

The invention relates to a sales rack for accommodating, in particular, foods presented in open containers, such as fruits, vegetables, etc., having a base and a goods support surface that is adjustable relative to the base.

2. The Prior Art

A sales rack of this type is known from practice and is described in German Patent No. DE 92 13 214 U1. Beyond this, a basket for offering bulk goods for sale is known, such as that discussed in German Patent No. DE 199 18 604 A1.

In the case of the sales stand according to DE 92 13 214 U1, a placement surface for goods to be offered for sale, which can be pivoted about a horizontal axis and adjusted at different angles, is implemented. The placement surface is held in its position by catch rods that lead downwards. The catch rods have a catch contour that is surrounded on at least three sides.

A similar sales rack is shown in U.S. published patent application no. 2001/0035385 A1, which shows a support surface that is set at a slant and is fitted with horizontal and vertical insertion walls. German Patent No. DE 690 00 802 T2 describes a shelf unit having partitions, in which each partition has a part that is flipped down, or a tongue, at one of its ends."

The known sales racks have fundamentally proven themselves, but their operation is complicated. Also, placing the goods on them requires a lot of physical effort, in part. In addition, it is difficult to hold the goods to be presented, particularly foods, in place at various locations of the goods support surface, which is regularly set at a slant. Here, the invention wishes to provide an overall remedy.

SUMMARY OF THE INVENTION

It is therefore an object of the invention to provide a sales rack for accommodating foods, particularly foods presented in open containers, in such a manner that the placement of goods succeeds easily even when the sales rack has the goods support surface set at a slant. In addition, it is an object of the invention to provide a sales rack where these goods can be fixed in place at practically any desired position of the goods support surface, without difficulty.

This object is achieved according to the invention by a sales rack where the goods support surface is equipped with at least one holder element which can be optionally affixed, and over which the goods, i.e. the containers can pass when they are put into place, to fix the goods in place in the slanted position of the goods support surface. As a rule, several holder elements are implemented.

The holder element is preferably a holder profile strip that can be inserted into the goods support surface, i.e. in general, the holder element is fixed in place on the goods support surface in an inserted manner. In addition to a holder profile strip, the invention furthermore pursues a holder element, which is configured so as to pivot relative to the goods support surface. Furthermore, the goods can pass over the holder element, in a particularly elegant manner, when they are placed on the goods support surface, and afterwards, the holder element assures that the goods are fixed in place on the goods support surface. In this connection, the holder element can possess a height, relative to a plane of the goods support surface, which amounts to a maximum of 30 mm. In particular, 20 mm has proven itself as a maximum height, and preferably, the range up to a maximum of 10 mm is actually preferred.

In order to facilitate passage of the containers or goods over the holder element, the latter has a cross-sectional shape that promotes such passage. For this purpose, the holder element can be configured to be round, elliptical, triangular, or in comparable manner. A ramp-like configuration in the direction of passage has proven to be advantageous. This is in view of the background that the containers or goods are pushed further and further up the slant, from the bottom to the top, as they are placed on the goods support surface.

The slanted position of the goods support surface is utilized for normal sales activities. Furthermore, however, the goods support surface can also be aligned horizontally relative to the base. This position is usually used during support of the sales rack. As possible slants, angles of approximately 10° to 60°, particularly 20° to 40°, have proven to be advantageous, whereby inclines in the range of approximately 30° or approximately 20° are preferred.

The holder element can be configured in an L shape, with a fixation ridge and a holder ridge. The fixation ridge ensures that the holder element can enter into the releasable connection with the goods support surface, as described. In contrast, the holder ridge ensures that in the slanted position of the goods support surface, the goods or containers that rest on it do not slide down the slant.

In a preferred embodiment, there is at least one U-shaped adjustment bracket connected with the goods support surface. This bracket engages with a holder in the base. Two adjustment brackets that are coupled with one another can be provided. These can be connected at the bottom of the goods support surface, approximately in the center and at the edge.

All the configurations can be combined with one another, and it has proven itself to configure the base as a block structure that is open at least at the top, whereby the goods support surface forms the head-side end of the block structure that is open at the top and, if necessary, open at the bottom. In other words, as soon as the goods support surface is aligned horizontally, in the transport position, the sales rack with the base and the goods support surface represents an essentially closed block.

The goods support surface preferably can be pivoted about an axis of rotation that runs essentially horizontally. This axis of rotation follows the longest side of the block. Furthermore, the axis of rotation can be offset into the base, in comparison with a front side of the base, by a predetermined dimension.

Preferably, the goods support surface is configured to be L-shaped in cross-section, with a longer L-shank that projects beyond the base at the back, and a short L-shank that fixes the goods in place in the slanted position of the goods support surface. The longer L-shank can also end with the base, in other words it does not necessarily project beyond it. When the axis of rotation is offset into the base, by the predetermined dimension, the goods support surface, set at a slant, projects beyond the front side of the base with its short L-shank, so that goods or containers resting against the latter can easily be removed, without the buyer colliding with the base, which is offset towards the rear, in comparison.

If the preferred holder brackets that can be pivoted relative to the goods support surface are used as holder elements instead of the holder profile strip, a counterweight provided on the holder bracket, in each instance, ensures that the holder bracket by the goods comes to rest essentially in the plane of the goods support surface, when the goods support surface is filled. Consequently it does not offer any resistance to the pushing movement.

Once this placement process has been completed, however, the counterweight on the holder bracket ensures that the holder bracket, i.e. its holder ridge, assumes its position in which it is exposed relative to the goods support surface, and consequently functions as a stop for the goods. An additional stop ridge on the holder bracket ensures that the holder ridge is not pivoted out of this exposed position by the goods that rest against it.

In the end result, a sales rack for accommodating foods, particularly foods presented in open containers, is made available, which rack is particularly suitable for the presentation and sale of fruits, vegetables, etc., in particular. Of course, other goods can advantageously be offered for sale with this rack, in a store or outdoors.

In this connection, a stable and optically appealing embodiment, overall, is made available, because the square tubes that are generally used for the base are made of chrome-plated steel. The same holds true for the goods support surface, which can have a grid grating, although a wood strip design is also possible.

A goods support surface having regularly recurring through-openings, i.e. a grid construction, represents an advantageous accommodation surface for the holder elements to be affixed on it. This is particularly true if a grid grating made of chrome-plated round steel rods is used at this point. This is because these round steel rods can each accommodate insertion elements, or can function as insertion elements, which can be used to affix the holder elements, i.e. fixed holder profile strips or pivoting holder brackets, on the goods support surface, in an optional manner, following the pattern of the grid. In this way, flexible positions of the individual goods or containers can be defined on the goods support surface, in its slanted position. Also, different sizes of containers and/or goods can easily be taken into account in this way.

The containers can be open boxes, film-wrapped units, cardboard cartons with inserts, or combinations, which contain the actual goods, particularly the fruits or vegetables. As a result of the passable holder elements, the containers in question can be placed on the goods support surface, coming to rest against the short L-shank of the latter. Subsequent to this, the containers are pushed up along the slant, whereby the passable holder elements ensure that this pushing process is not significantly impaired. For this purpose, ramp-like or correspondingly configured cross-sectional shapes of the holder elements have proven to be advantageous, which (in combination with pivoting of the holder elements towards the plane of the goods support surface, if necessary) make the pushing movement up the slant possible, as described. These are the significant advantages.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Referring now in detail to the drawings, the figures show a sales rack that is particularly suitable for, but not limited to, accommodating goods such as fruits, vegetables, etc., presented in open containers. For this purpose, the sales rack is placed in stores, whereby a goods support surface 1 is arranged at a slant relative to a base 2, specifically in the direction towards the buyers who are being addressed. For this purpose, the goods support surface 1 can be adjusted relative to the base 2. According to the exemplary embodiment, a (single) angle $\alpha$ of the slanted incline is implemented, which assumes values of approximately 30° or approximately 20°. Fundamentally, however, other angles a are also possible, and are covered by the idea of the invention, as is the possibility of working with a varying angle $\alpha$ (see FIG. 3).

The goods support surface 1. has at least one holder element generally referred to as 3. Holder element 3 prevents the goods or containers placed on goods support surface 1 from sliding down the slant formed as a result of angle $\alpha$. Depending on the size of the container or the goods, holder element 3, in each instance, can optionally be affixed on goods support surface 1, and fixes the goods in place in the slanted position of goods support surface 1.

In order to now be able to put goods/containers on goods support surface 1 without problems, it is possible for the goods/containers to pass over individual holder elements 3, which are optionally and, of course, releasably affixed on goods support surface 1. This means that a movement of the containers or goods in pushing direction S, along the slant, starting at the short L-shank 1*a* of goods support surface 1, is not hindered, or is only hindered insignificantly. The goods or containers can therefore be pushed up the long L-shank 1*b* of L-shaped goods support surface 1, in direction S, without problems (see FIGS. 1 and 5).

Figure 1:
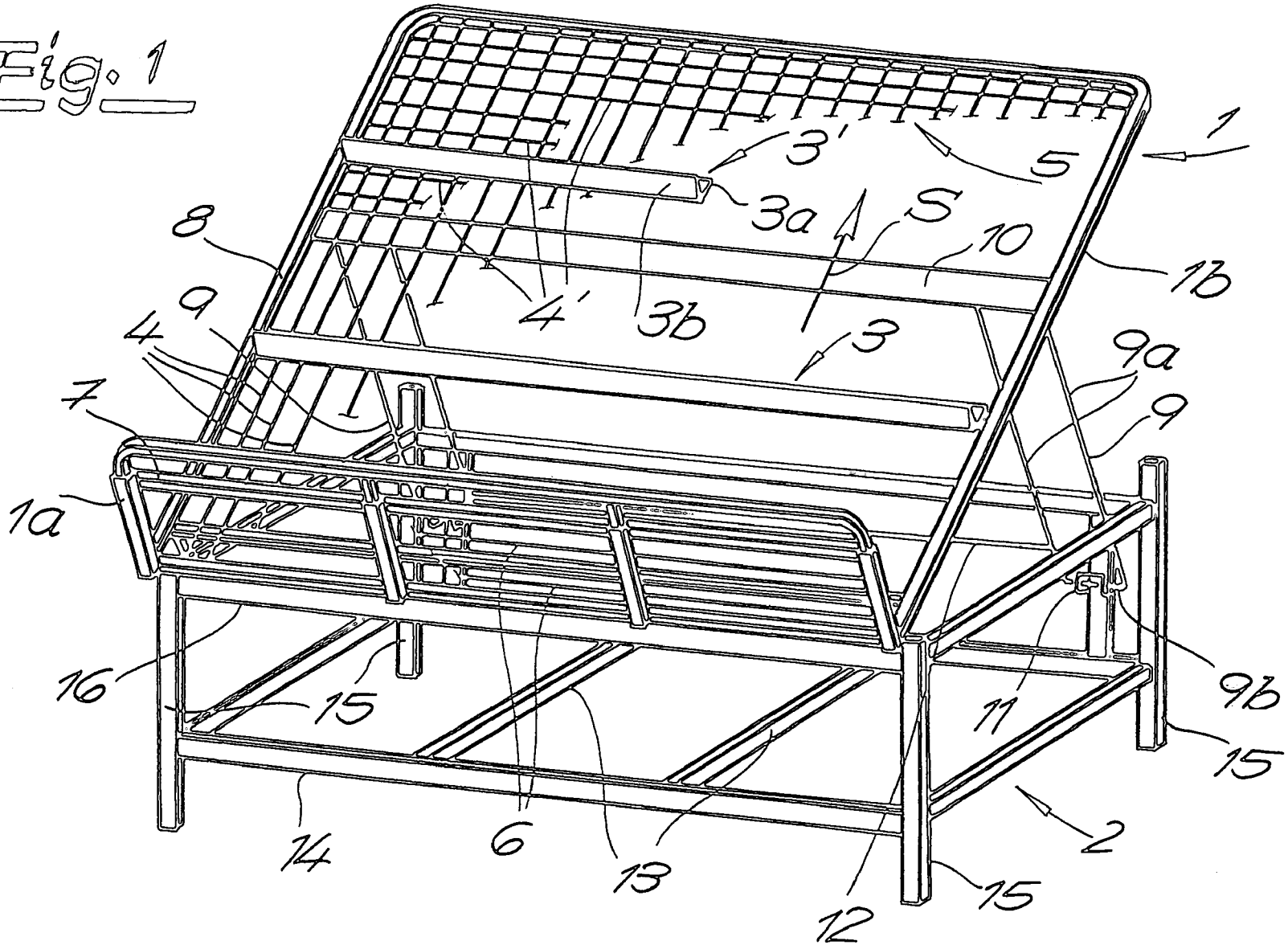
FIG. 1 shows a preferred embodiment of the sales rack according to the invention, in a perspective view, with the goods support surface in the slanted position.
Figure 2:
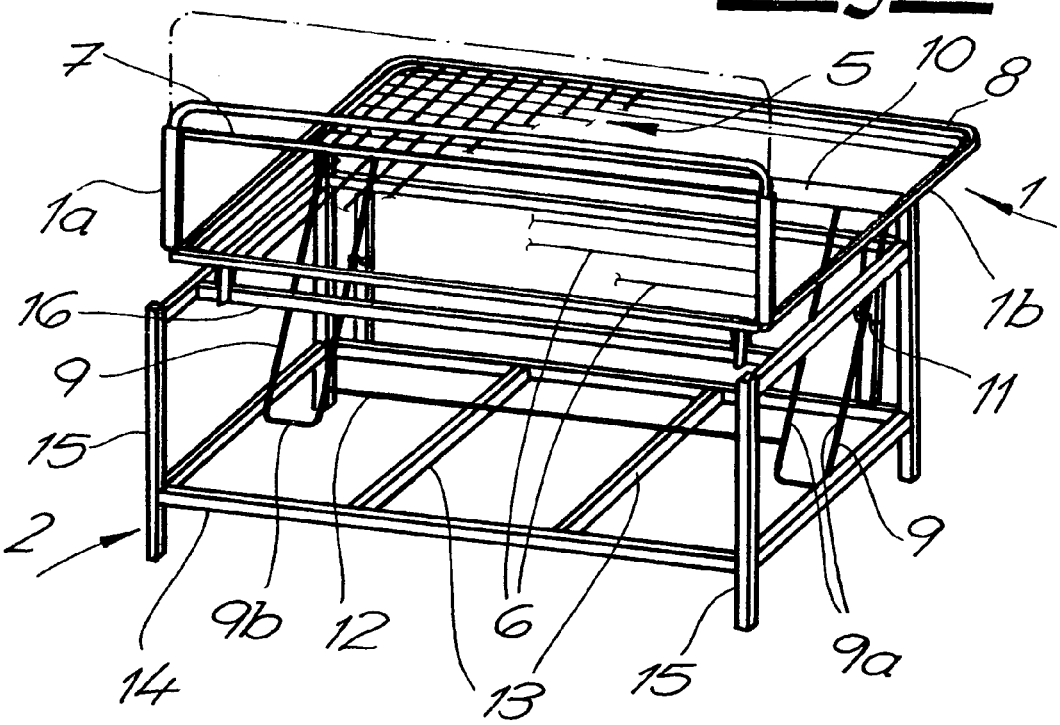
FIG. 2 shows the embodiment according to FIG. 1, with the goods support surface in the horizontal position.
Figure 3:
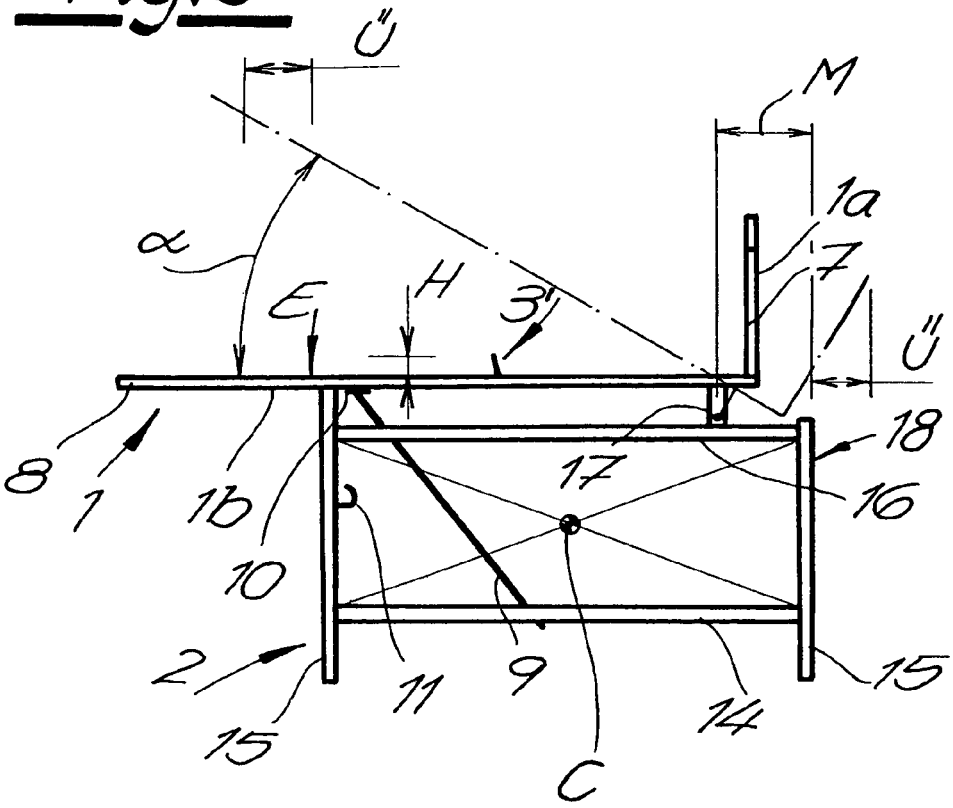
FIG. 3 shows the embodiment according to FIGS. 1 and 2 in a side view.
Figure 4:
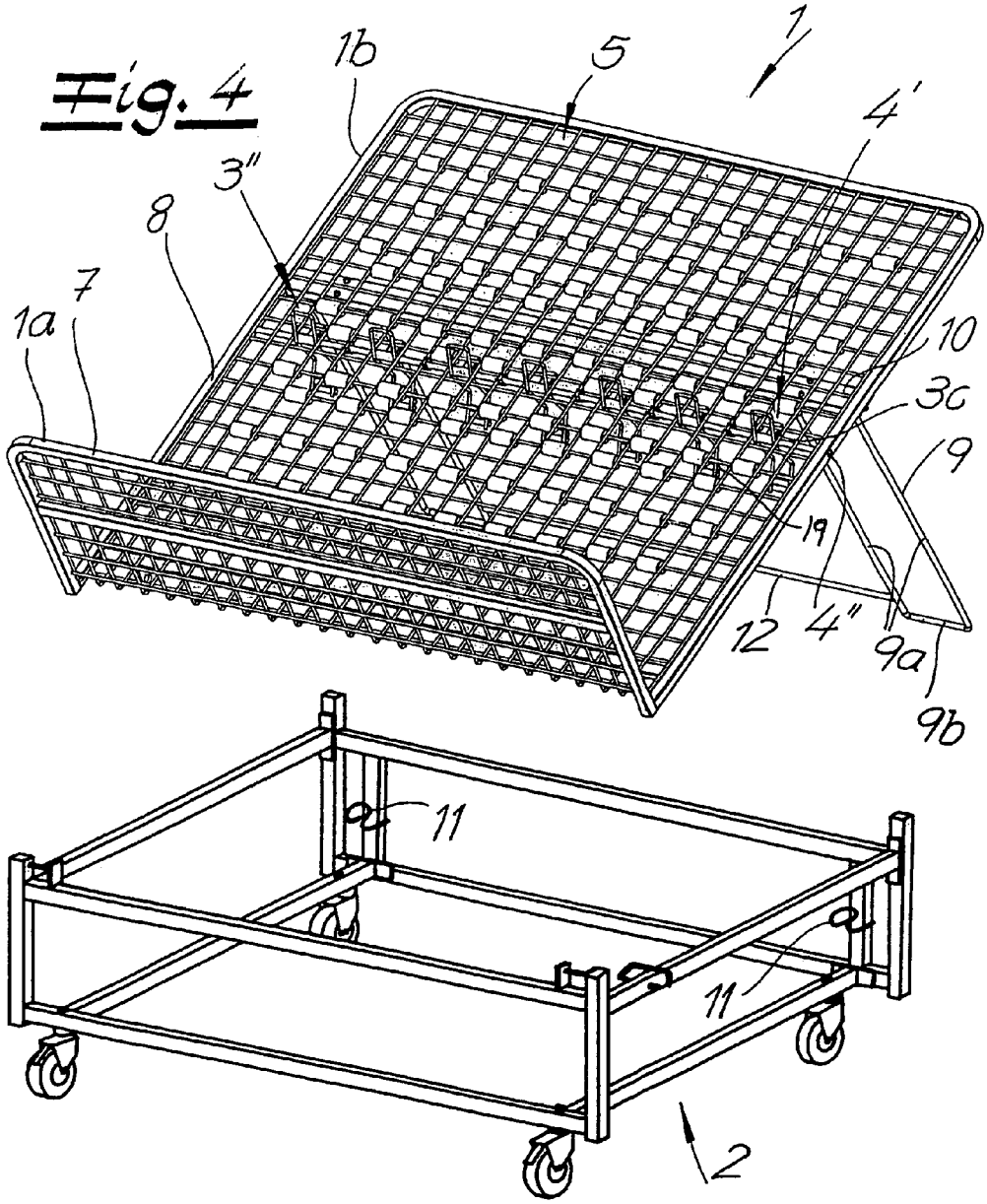
FIG. 4 shows a modified embodiment of the sales rack according to FIG. 1 to 3.
Figure 5:
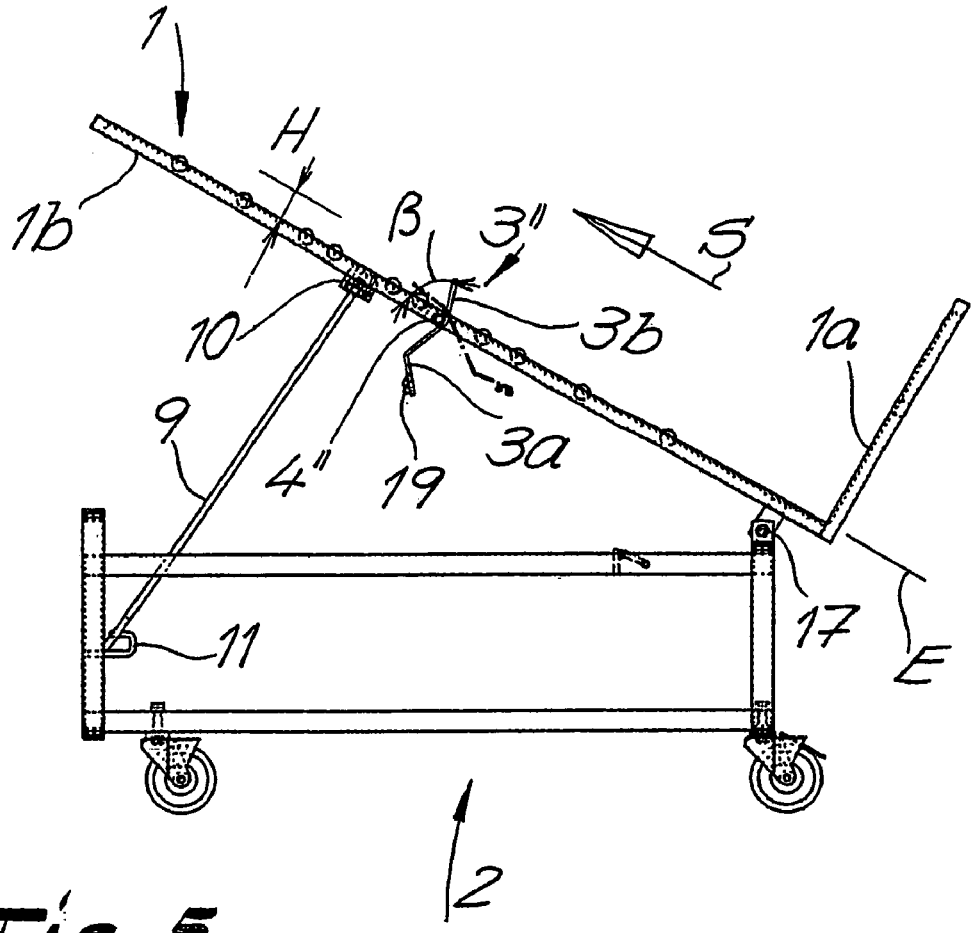
FIG. 5 shows a side view of the embodiment according to FIG. 4.

In the embodiment of FIGS. 1 to 3, the holder element(s) is/are holder profile strips 3' that can be inserted into goods support surface 1. In the embodiment of FIGS. 4 and 5 the holder elements are configured as holder brackets 3" that can be pivoted in comparison with goods support surface 1. In this connection, the holder elements have in common that they can be attached to goods support surface 1 in an inserted manner and optionally, in each instance. For this purpose, the holder elements comprising profile strips 3' and holder brackets 3" are configured in an L shape, with a fixation ridge 3*a* and a holder ridge 3*b*.

With holder profile strips 3', fixation ridge 3*a* there has clips or catch elements or insertion elements, not explicitly shown, on its bottom facing goods support surface 1, which engage individual round rods 4 of a grid grating 5, so as to engage and be released. In this way, holder profile strips 3' can be optionally and releasably affixed to goods support surface 1.

With holder brackets 3", this releasable and optional attachment is achieved in that grid grating 5 has at least one round rod 4" that can be inserted and removed, and runs horizontally in the exemplary embodiment. This round rod 4" holds the pivoting holder brackets 3" that are mounted to rotate on round rod 4" in question, in. their position. Round rod 4" can also assume different positions, other than the position shown in FIG. 4. The same consequently holds true also for pivoting holder brackets 3". Round rod 4"that can be inserted and runs horizontally can also be used without a holder bracket 3"being connected with it so as to rotate. This means that holder brackets 3" can be optionally and releasably affixed to goods support surface 1.

Grid grating 5, together with round rods 4, forms the long L-shank 1*b* in the cross-section of goods support surface 1. In contrast, only lengthwise struts 6 are implemented on short L-shank 1*a*, which are surrounded by a frame 7 made of a square tube (see FIG. 1 to 3). As an alternative to this, a grid grating in accordance with FIGS. 4 and 5 can also be used. Grid grating 5 is also surrounded by a frame 8 made of a square tube. Both frames 7, 8 have rounded edges, in each instance, in order to preclude possible injuries.

Holder holder ridge 3*b*, has a height H relative to a goods support surface E that is in the range below 20 mm, preferably below 10 mm, in the framework of the exemplary embodiment. In this way, passage over holder profile strip 3 or holder bracket 3", as described, can be assured, in combination with a special cross-sectional profile of holder profile strip 3' or holder bracket 3". In this connection, a round or elliptical cross-sectional shape has proven to be advantageous. Triangular cross-sectional shapes of holder ridge 3*b* are also possible. Likewise, holder ridge 3*b* can also have a slant counter to direction S, which facilitates passage over holder profile strip 3' or holder bracket 3".

Goods support surface 1 possesses at least one U-shaped adjustment bracket 9. This U-shaped adjustment bracket 9 is connected with goods support surface 1 in articulated manner with its two U-shanks 9*a*, specifically and advantageously to a crossbar 10, which stabilizes grid grating 5 and therefore the goods support surface 1 as a whole. The two U-shanks 9*a* are connected with one another by means of a U-base 9*b*. Adjustment bracket 9 engages in a holder 11 on the base 2. In this embodiment, holder 11 on base 2 is a round hook 11 into which U-base 9*b* of U-shaped adjustment bracket 9 is hung.

Within the framework of the exemplary embodiment, two adjustment brackets 9, coupled with one another, are implemented. The two adjustment brackets 9 are connected with the bottom of goods support surface 1 approximately in the center and at the edge. A connection strut 12 serves to couple the two adjustment brackets 9. Connection strut 12 ensures that when adjustment brackets 9 are taken out of holder 11, goods support surface 1 and consequently the two adjustment brackets 9 that are coupled with one another are nevertheless guided without problems, specifically along a cross-tube 13 that is provided in the base. In fact, two cross-tubes 13 are implemented, which run in a frame 14 of the base 1. Frame 14 connects four vertical tubes 15 with one another as feet of the base 1. The same holds true for another frame 16, which does not have any cross-tubes, however.

Cross-tubes 13 in frame 14 ensure that the two adjustment brackets 9 and consequently goods support surface 1 are guided perfectly during the transition from their horizontal position for transport, according to FIG. 2, into the sales position according to FIG. 1 as well as 4 or 5. For this purpose, goods support surface 1 can be pivoted about an axis of rotation 17—as indicated in FIG. 3—which runs horizontally in the direction of the longest side of block-shaped base 2. Axis of rotation 17 is offset into the base by a predetermined dimension M, in comparison with front side 18 of base 1. The exemplary embodiment according to FIGS. 4 and 5, on the other hand, does not provide for any offset of the axis of rotation 17.

In this way, the overall result is achieved that the goods support surface is equipped with approximately equal overhangs Ü of short L-shank 1*a* and of long L-shank 1*b* relative to the base 2. This is directly shown by the dot-dash line representation in FIG. 3. In this way, a particularly even load distribution is achieved, and the center of gravity C of the loaded sales rack is arranged approximately in the intersection of the diagonals of the base 2, in order to achieve maximal stability of the sales rack. The same conditions occur in the embodiment according to FIGS. 4 and 5.

In contrast, the long L-shank 1*b* projects beyond base 1 towards the back, relatively clearly, in its horizontal position, as is made clear by the solid line representation in FIG. 3.

All of frames 7, 8 and 14, 16, just like vertical tubes 15, are made of square steel tubes. These steel tubes, just like grid grating 5 and its round rods 4, have a chrome plating, so that an appealing exterior is achieved and, in particular, the suitability for presentation of foods exists. Furthermore, round rods 4 lie on round rods 4', which run perpendicular to the former, in the pushing direction S, in order to facilitate pushing the goods or containers up along the slanted goods support surface 1. Round rods 4 consequently form goods support surface plane E.

In total, the goods can be lined up without gaps relative to one another, using the sales rack described, without the containers, i.e. crates, being optically perceived. This results in a three-dimensional impression of the goods, without visible box edges. Pressure points on the vegetables or fruits can be prevented in this way, because they are gently stored in the containers, in each instance, i.e. in appropriately shaped cardboard boxes.

Figure 6:
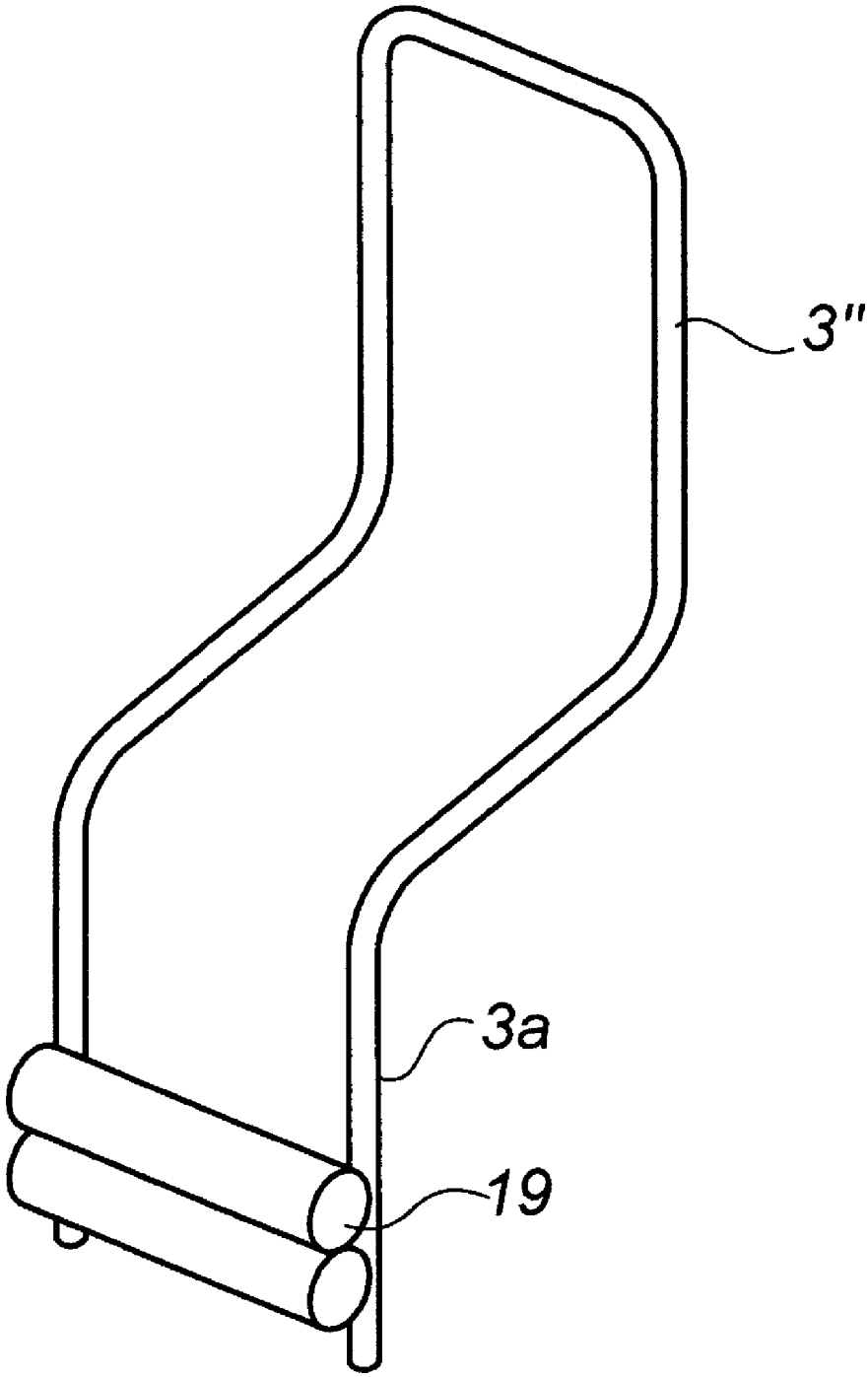
FIG. 6 shows a detailed view of holder bracket 3" with counterweight 19.

Holder elements 3, i.e. holder brackets 3", with their holder ridge 3*b*, assume their exposed position, i.e. height H relative to the goods support surface plane E, in the state of rest, as is shown with a solid line in FIG. 5. One or more counterweights 19, as also shown in FIG. 6, assure this. Counterweights 19 are provided on the ends of fixation ridge 3*a*, which is used to mount holder bracket 3" to rotate on round rod 4", in each instance. Stops, not explicitly shown, can assure that this position is assumed (shown with a solid line) in FIG. 5.

If containers or goods are now pushed up along the slant, i.e. goods support surface 1, in pushing direction S, the pivoted mounting of holder brackets 3" assures that holder ridge 3*b* is laid down onto goods support plane E or dips into it. This is shown by the position drawn with a dot-dash line in FIG. 5.

As soon as the goods that have been pushed up have passed holder bracket 3", counterweight 19 ensures that holder ridge 3*b* resumes its exposed position (shown with a solid line), essentially perpendicular in comparison with goods support surface plane E. In this connection, the goods that have been pushed up are fixed in place on holder ridge 3*b*, because in this regard, an additional stop ridge 3*c* on the holder bracket 3" engages below an adjacent round rod 4' as a stop (see FIG. 4). Of course, a different stop could also be used at this point.

In this way, it is ensured that holder bracket 3", in each instance, can only pivot in the clockwise direction, into the position shown with a dot-dash line, and back in the counterclockwise direction, into the position shown with a solid line. This means that holder ridge 3*b* passes through a pivot angle of $\beta \approx 90°$, which is predetermined by the stops described. This pivot angle $\beta$ extends between the essentially perpendicular position of the holder ridge 3*b* in comparison with the goods support surface plane E, and a parallel position relative to the goods support surface plane E, i.e. the position of the holder ridge 3*b* in the goods support surface plane E. Greater angles than the pivot angle $\beta$ indicated, of approximately 90°, are not permitted, in order to prevent the goods from slipping off goods support surface 1.

By using holder elements 3, such as holder profile strips 3', or holder brackets 3", which can be optionally affixed and, of course, adjusted, as well as passed over, the sales rack described can be filled, even in the top row, without any problems and without unnecessary expenditure of force.

Accordingly, while only a few embodiments of the present invention have been shown and described, it is obvious that many changes and modifications may be made thereunto without departing from the spirit and scope of the invention.

What is claimed is:

1. A sales rack for accommodating goods, comprising:

a base;

a goods support surface on said base that is adjustable relative to said base, said goods support surface having a plane (E); and at least one holder element comprising a holder bracket removably affixed to said goods support surface, said holder bracket adapted to pivot relative to said goods support surface, and over which the goods pass when they are put into place, to fix the goods in place in a slanted position of the goods support surface, wherein the holder element has counterweight and a holder crosspiece, and wherein the counterweight moves the holder crosspiece to a predetermined height (H) relative to the goods support surface plane (E) in a state of rest, and the holder crosspieces lies in the goods support plane (E) during placement of goods on the goods support surface.

2. The sales rack according to claim 1, wherein the at least one holder element is attached to the goods support surface in an insertable manner.

3. The sales rack according to claim 1, wherein the holder element has a cross-sectional shape of round, elliptical or triangular, that promotes passage of the goods over said holder element.

4. The sales rack according to claim 1, wherein the holder element is L-shaped, with a fixation ridge and a holder ridge.

5. The sales rack according to claim 1, further comprising at least one U-shaped adjustment bracket connected with the goods support surface and engaging in a holder of the base.

6. The sales rack according to claim 5, wherein there are two adjustment brackets that are coupled with one another and connected with a bottom of the goods support surface approximately in a center and at an edge of said goods support surface.

7. The sales rack according to claim 1, wherein the base is a block structure that is open at least towards a top, and is made of square struts with the goods support surface on the top.

8. The sales rack according to claim 1, wherein the goods support surface is L-shaped in cross-section, with a long L-shank and a short L-shank that fixes the goods in place in the slanted position of the goods support surface.

* * * * *